US008766080B2

(12) United States Patent
Ho

(10) Patent No.: US 8,766,080 B2
(45) Date of Patent: Jul. 1, 2014

(54) METHODS, SYSTEMS, AND MEDIA FOR PERFORMING VISUALIZED QUANTITATIVE VIBRATO ANALYSIS

(71) Applicant: ArtstoTao Inc., Rego Park, NY (US)

(72) Inventor: Tracy Kwei-Liang Ho, Rego Park, NY (US)

(73) Assignee: ArtstoTao Inc., Rego Park, NY (US)

( * ) Notice: Subject to any disclaimer, the term of this patent is extended or adjusted under 35 U.S.C. 154(b) by 0 days.

(21) Appl. No.: 13/827,064

(22) Filed: Mar. 14, 2013

(65) Prior Publication Data

US 2013/0340595 A1 Dec. 26, 2013

Related U.S. Application Data

(60) Provisional application No. 61/758,583, filed on Jan. 30, 2013.

(30) Foreign Application Priority Data

Jun. 22, 2012 (TW) ..... 101122407 A

(51) Int. Cl.
*G10H 1/00* (2006.01)

(52) U.S. Cl.
USPC ..... 84/615; 84/629

(58) Field of Classification Search
USPC ..... 84/615
See application file for complete search history.

(56) References Cited

U.S. PATENT DOCUMENTS 5,536,902 A * 7/1996 Serra et al. ..... 84/623
5,792,971 A * 8/1998 Timis et al. ..... 84/609

* cited by examiner

*Primary Examiner* — Christopher Uhlir
(74) *Attorney, Agent, or Firm* — Byrne Poh LLP

(57) ABSTRACT

Methods, systems, and media for performing visualized quantitative vibrato analysis are provided. In some embodiments, a method for analyzing musical vibrato in an audio file is provided, the method comprising: receiving, using a hardware processor, a target note from a user; receiving, using the hardware processor, a time-domain signal representing a piece of music comprising a plurality of notes, wherein the plurality of notes include the target note and the target note is played with a vibrato effect; converting, using the hardware processor, the time-domain signal to a frequency-domain signal; determining, using the hardware processor, a plurality of changes in frequency and intensity of the vibrato effect over time based on the frequency-domain signal; determining, using the hardware processor, a target frequency corresponding to the target note; and displaying, on a display, data about the changes in frequency and intensity of the vibrato effect over time and data about the target frequency.

6 Claims, 10 Drawing Sheets

400

600

700

800

900

METHODS, SYSTEMS, AND MEDIA FOR PERFORMING VISUALIZED QUANTITATIVE VIBRATO ANALYSIS

CROSS REFERENCE TO RELATED APPLICATION

This application claims the benefit of U.S. Provisional Patent Application No. 61/758,583, filed Jan. 30, 2013, and Taiwan Patent Application No. 101122407, filed Jun. 22, 2012, each of which is hereby incorporated by reference herein in its entirety.

TECHNICAL FIELD

Methods, systems and media for performing visualized quantitative vibrato analysis are provided.

BACKGROUND

Vibrato is an indispensable technique for obtaining profound music expression in vocal and instrumental music. For example, a violinist can play a musical note with vibrato through to-and-fro motion of his fingers. The conflicting theories about the different types of vibrato frequency variations and their production techniques can confuse music students who are learning how to play vibrato. In addition, the conventional methods of analyzing and teaching vibrato are highly subjective and lack objective standards that can be easily followed by music students.

Accordingly, it is desirable to teach how to produce as vibrato effect using a system that can perform visualized quantitative vibrato analysis.

SUMMARY

Methods, systems, and media for performing visualized quantitative vibrato analysis are provided. In some embodiments, methods for analyzing musical vibrato in an audio file are provided, the methods comprising: receiving, using a hardware processor, a target note from a user; receiving, using the hardware processor, a time-domain signal representing a piece of music comprising a plurality of notes, wherein the plurality of notes include the target note and the target note is played with a vibrato effect; converting, using the hardware processor, the time-domain signal to a frequency-domain signal; determining, using the hardware processor, a plurality of changes in frequency and intensity of the vibrato effect over time based on the frequency-domain signal; determining, using the hardware processor, a target frequency corresponding to the target note; and displaying, on a display, data about the changes in frequency and intensity of the vibrato effect over time and data about the target frequency.

In some embodiments, systems for analyzing musical vibrato in an audio file are provided, the systems comprising: at least one hardware processor that is configured to: receive a target note from a user; receive a time-domain signal representing a piece of music comprising a plurality of notes, wherein the plurality of notes include the target note and the target note is played with a vibrato effect; convert the time-domain signal to a frequency-domain signal; determine a plurality of changes in frequency and intensity of the vibrato effect over time based on the frequency-domain signal; and determine a target frequency corresponding to the target note; and at least one display that is configured to: display data about the changes in frequency and intensity of the vibrato effect over time and data about the target frequency.

In some embodiments, computer readable media containing computer-executable instructions that, when executed by a processor, cause the processor to perform a method for analyzing musical vibrato in an audio file are provided, the method comprising: receiving a target note from a user; receiving a time-domain signal representing a piece of music comprising a plurality of notes, wherein the plurality of notes include the target note and the target note is played with a vibrato effect; converting the time-domain signal to a frequency-domain signal; determining a plurality of changes in frequency and intensity of the vibrato effect over time based on the frequency-domain signal; determining a target frequency corresponding to the target note; and displaying data about the changes in frequency and intensity of the vibrato effect over time and data about the target frequency.

BRIEF DESCRIPTION OF THE DRAWINGS

Various objects, features, and advantages of the disclosed subject matter can be more fully appreciated with reference to the following detailed description of the disclosed subject matter when considered in connection with the following drawings, in which like reference numerals identify like elements.

DETAILED DESCRIPTION

In accordance with various embodiments, as described in more detail below, mechanisms for performing visualized quantitative vibrato analysis are provided. These mechanisms can be used to teach and learn techniques for singing a vocal vibrato or playing vibrato with a musical instrument such as a violin, a cello, a guitar, etc.

In some embodiments, after receiving a target note to which a vibrato effect can be applied, an audio file containing a piece of music in which the target note is played with vibrato can be received. For example, an audio file can be imported from a storage device. Alternatively or additionally, a user can play the piece of music by applying vibrato to the target note. An audio file can then be produced by recording the user's real-time performance. Spectrum analysis can be performed on the audio file using any suitable methods. For example, a fast Fourier transform (FFT) can be performed on a time-domain signal representing the piece of music contained in the audio file and a frequency-domain signal can be generated accordingly. Spectrum data about the vibrato applied to the target note can be generated based on the frequency-domain signal. Quantitative analysis can be performed on the spectrum data based on various parameters of the vibrato, such as the frequency variation, the intensity variation, the frequencies with the highest intensities during each cycle of vibrato, the correspondent relationship between the frequency and intensity variations during each cycle of vibrato, etc. Multiple characteristics of the vibrato can be determined based on the spectrum analysis and the quantitative analysis. In some embodiments, the characteristics of the vibrato can be displayed on a display device. The multiple characteristics of the vibrato can be used to evaluate the quality of the performance recorded in the audio file, such as intonation, stability, etc.

In some embodiments, a user can study the preferable way to play a vibrato using the disclosed invention. For example, the user can play a piece of music by applying vibrato effect to a target note. The user's performance can be recorded by a suitable recording device. A sample performance of the vibrato can be generated to illustrate a desirable way to perform the vibrato. The user can playback his performance and the sample performance using a suitable playback device. Spectrum and quantitative analysis can be performed on the user's performance and the sample performance to generate two sets of statistics. The two sets of statistics can be displayed on a screen. The user can study the techniques for playing a vibrato using the two sets of statistics.

Figure 1:
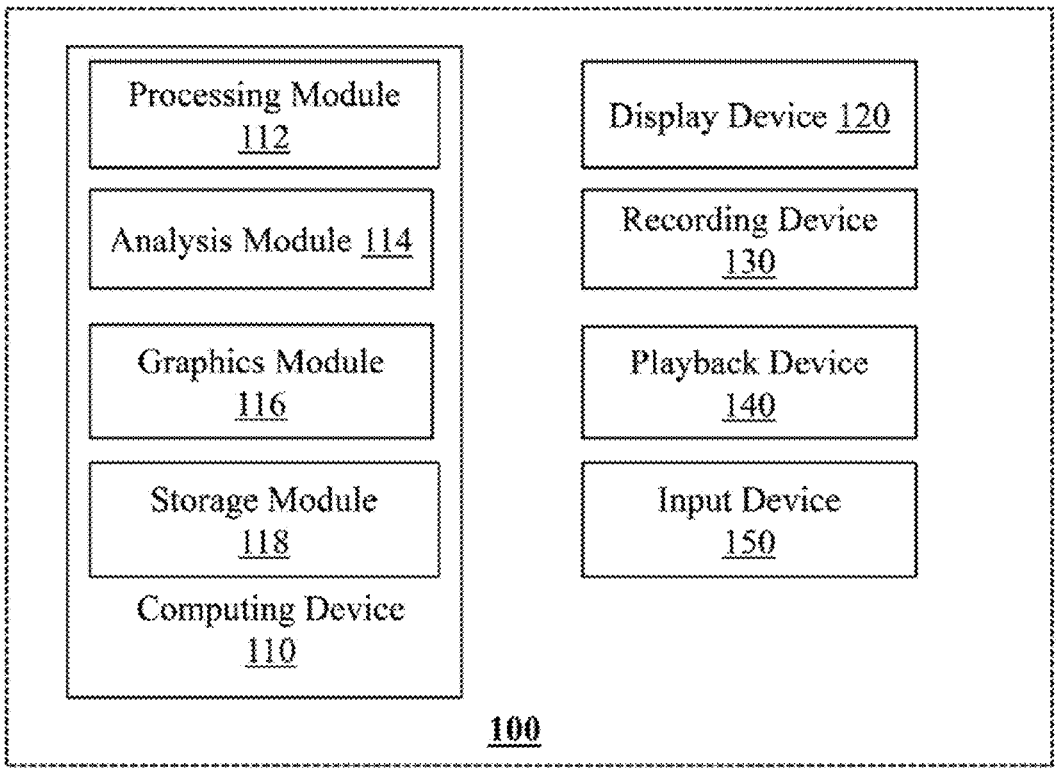
FIG. 1 is an example of a generalized schematic diagram of a system for performing visualized vibrato analysis in accordance with some implementations of the disclosed subject matter.

Turning to FIG. 1, an example of a generalized schematic diagram of a system for performing visualized vibrato analysis in accordance with some implementations of the disclosed subject matter is shown. As illustrated, system 100 can include computing device 110, display device 120, recording device 130, playback device 140, and input device 150.

Computing device 110 can be a general purpose device such as a computer or a special purpose device such as a client, a server, etc. Any of these general or special purpose devices can include any suitable components such as a processor (which can be microprocessor, digital signal processor, a controller, etc.), memory, communication interfaces, display controllers, input devices, etc. For example, computing device 110 can be implemented as a personal computer, a tablet computing device, a personal digital assistant (PDA), a portable email device, a multimedia terminal, a mobile telephone, a gaming device, a set-top box, a television, etc.

As illustrated in FIG. 1, computing device 110 can include processing module 112, analysis module 114, graphic module 116, and storage module 118. Processing module 112, analysis module 114, and graphic module 116 can be implemented as one or more hardware processors, such as digital signal processors (DSPs), microprocessors, controllers, FPGAs, or any suitable general or special purpose processors. Storage module 118 can include a hard drive, a digital video recorder, a solid state storage device, a gaming console, a removable storage device, or any other suitable storage device. Each of the modules 112, 114, 116, and 118 can be implemented as a stand-alone module or integrated with other components of system 100.

Display device 120 can be provided as a stand-alone device or integrated with other elements of system 100. Display device 120 can be one or more of a monitor, a television, a liquid crystal display (LCD) for a mobile device, or any other suitable equipment for displaying visual images. In some embodiments, display device 120 can be three-dimensional capable. In some embodiments, display device 120 can be a touchscreen.

Recording device 130 can be a digital audio recorder, an analog audio recorder, a personal video recorder (PVR), digital video recorder (DVR), video cassette recorder (VCR), a digital video disk (DVD) recorder, compact disc recorder, a smartphone, or any other suitable recording device or storage device. In some embodiments, recording device 130 can include a storage device for storing or recording content or data recorded or provided by other components of system 100.

Playback device 140 can be as gaming system (e.g., X-BOX, PLAYSTATION, or GAMECUBE) or a portable electronic device, such as a portable DVD player, a portable gaming device, a cellular telephone, a personal digital assistant (PDA), a music player (e.g., a MP3 player), or any other suitable fixed or portable device.

Input device 150 can be a computer keyboard, a mouse, a keypad, a cursor-controller, a remote control, or any other suitable input device as would be used by a designer of input systems or process control systems. Alternatively, input device 150 can be a finger-sensitive or stylus-sensitive touch screen input of display device 120. Input device can also be a microphone or other voice recognition device which can receive acoustic input from a user.

Figure 2:
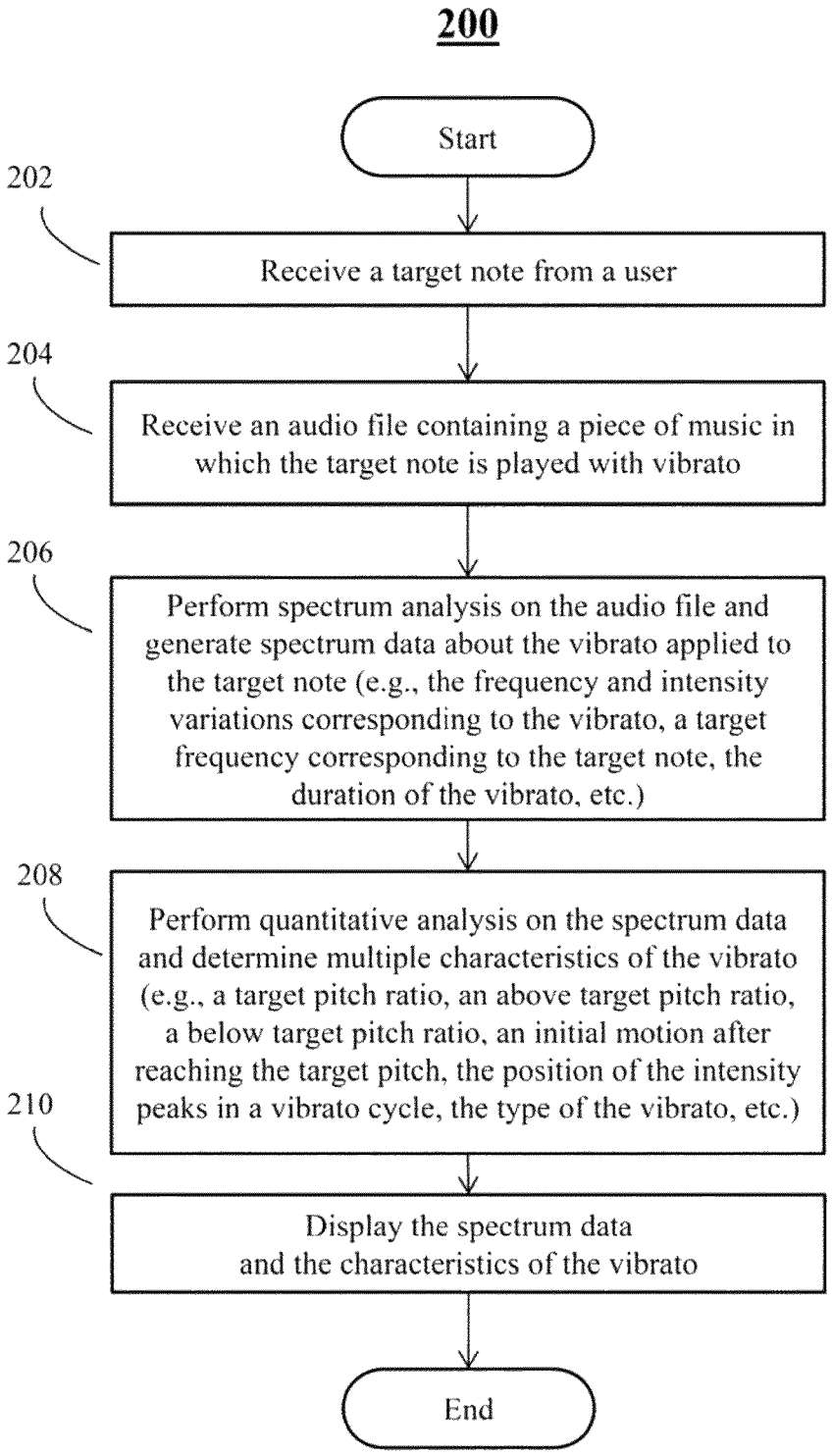
FIG. 2 is a flow chart of an example of a process for performing visualized vibrato analysis in accordance with some implementations of the disclosed subject matter.

Turning to FIG. 2, a flow chart of an example of a process for performing visualized vibrato analysis in accordance with some implementations of the disclosed subject matter is shown.

Figure 4:
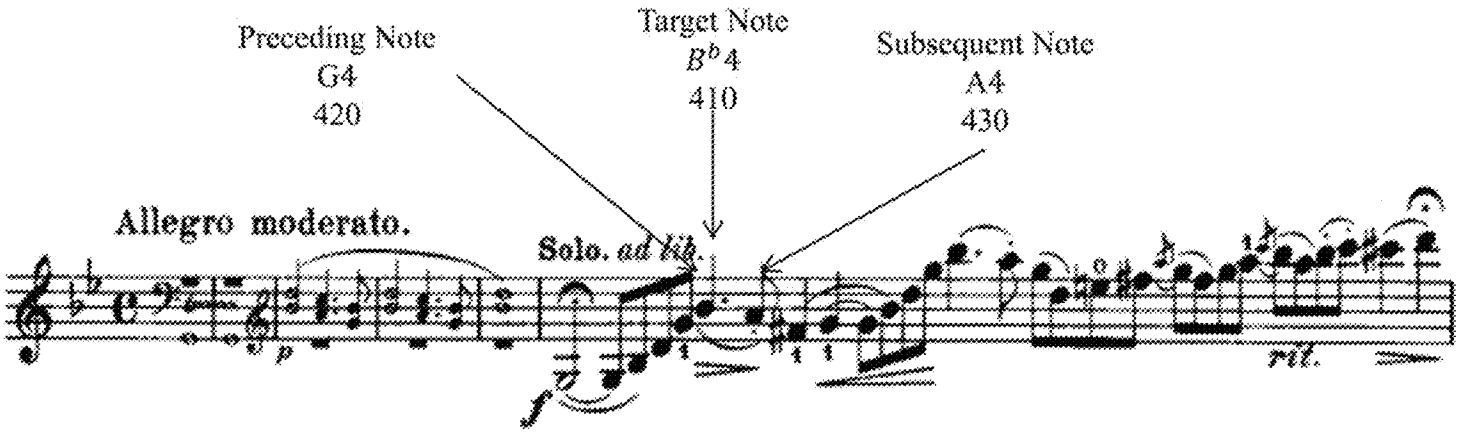
FIG. 4 is an example of a piece of music including a target note which can be played with vibrato in accordance with some implementations of the disclosed subject matter.
Figure 5:
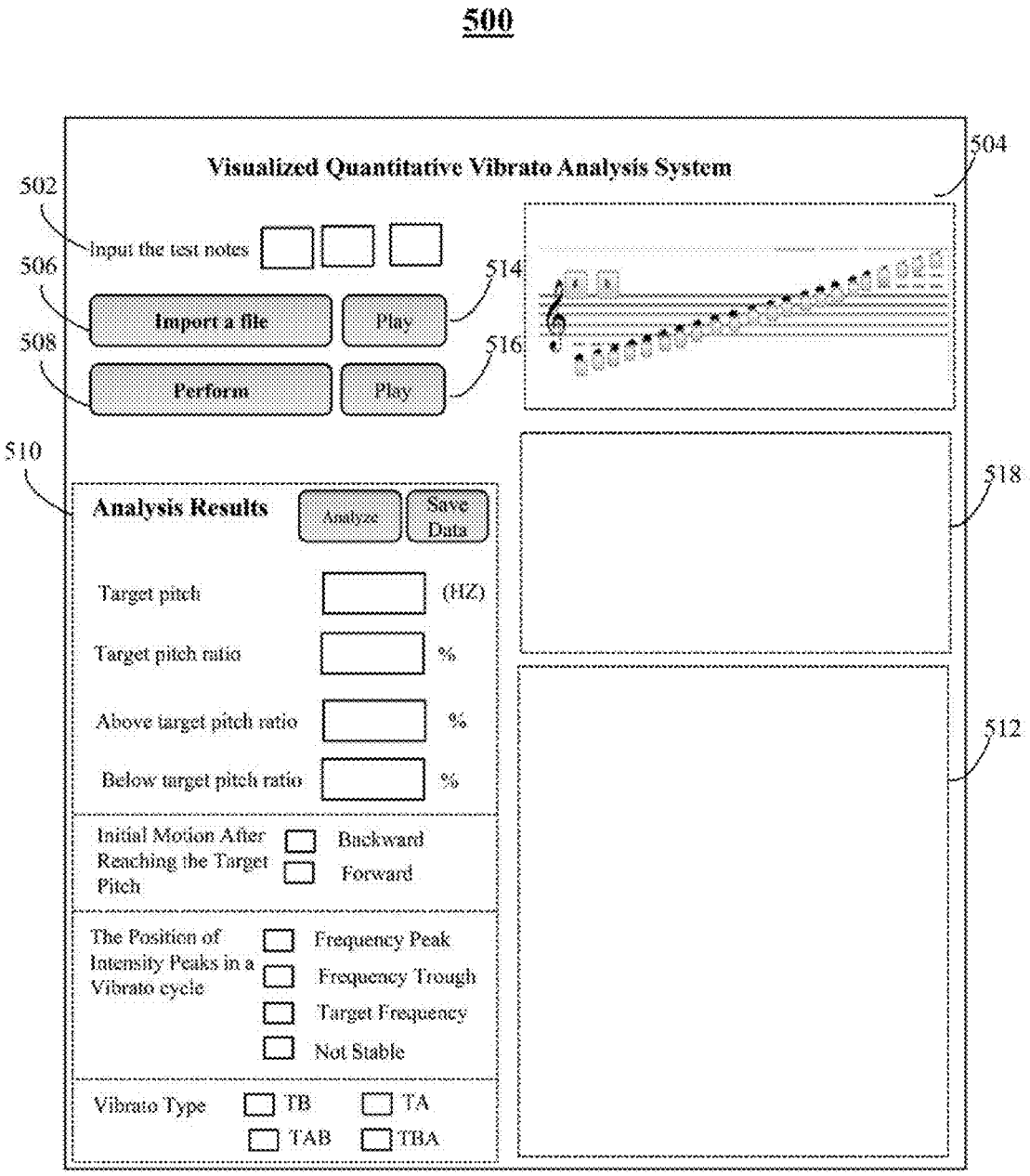
FIG. 5 is an example of a user interface for performing visualized quantitative vibrato analysis in accordance with some implementations of the disclosed subject matter.

Process 200 can begin by receiving a target note from a user at 202. For example, as shown in FIG. 5, user interface 500 can be presented to a user on a screen of display device 120. The user can then identify a target note using user interface 500. More particularly, for example, the user can identify a target note by entering the name of the target note in test notes input area 502 of user interface 500 through input device 150. Alternatively or additionally, the user can identify a target note by clicking a portion of staff panel 504 corresponding to the target note. The user can also identify a sharp or flat note by clicking the sharp button "#" or flat button "b" on staff panel 504 after identifying a note. In some embodiments, the user can also identify a preceding note that will be played immediately before the target note and a subsequent note that will be played immediately after the target note. For example, as shown in FIG. 4, notes 420, 410, and 430 can be played sequentially and note 410 can be played with vibrato. A user can identify note 410 as the target note by entering $B^b4$ in test notes input area 502 (FIG. 5) or by clicking the part of staff panel 504 (FIG. 5) corresponding to note B4 and the flat button. In addition, the user can also identify note 420 (note G4) which will be played immediately before target note 410 and note 430 (note A4) which will be played immediately after the target note 410. In some embodiments, a user can identify three notes that will be played sequentially and system 100 can identify the second note input by the user as the target note. For example, the user can enter G4, $B^b4$, and A4 in test notes input area 502 of user interface 500 as illustrated in FIG. 5. The second note identified by the user, e.g., note $B^b4$, can be recognized as the target note by system 100.

Referring back to FIG. 2, at 204, an audio file containing a piece of music in which the target note is played with vibrato can be received. For example, as shown in FIG. 5, a user can click button 506 of user interface 500 to import a pre-recorded audio file. In a more particular example, the user can import an audio file that is stored in storage module 118. Alternatively or additionally, the user can import an audio file from any suitable local or remote storage device. For example, the user can import an audio file from ROM, RAM, a CD-ROM, a hard disk, a flash disk, or any suitable storage device. Alternatively or additionally, the user can download an audio file from a server via the Internet or any suitable network. The audio can have any suitable format, such as mp3, wma, wav, ocd, MPEG-4 DST, etc.

In another example, a user can click panel 508 of user interface 500 to record an audio file containing a piece of music in which the target note is played with vibrato. More particularly, for example, the user can play a piece of music by applying vibrato to the target note. Recording device 130 can record the user's performance in real time and produce an audio file accordingly. In some embodiments, the audio file can be stored in storage module 118 or any suitable storage device.

Referring back to FIG. 2, at 206, computing device 110 can perform spectrum analysis on the audio file and generate spectrum data about the vibrato applied to the target note. As described in connection with FIG. 3, for example, computing device 110 can receive a time-domain signal representing the piece of music contained in the audio file. Computing device 110 can then convert the time-domain signal into a frequency-domain signal. Computing device 110 can also determine variations of the fundamental frequency and the intensity of the fundamental frequency over time, a target frequency corresponding to the target note, the duration of the vibrato, and other spectrum data about the vibrato applied to the target note. More particularly, for example, graphic module 116 can plot the fundamental frequency and its corresponding intensity versus time and generate a graphic representing the fundamental frequency and intensity variation over time.

At 208, computing device 110 can perform quantitative analysis on the spectrum data and determine multiple characteristics of the vibrato applied to the target note. For example, analysis module 114 can analyze the spectrum data within the duration of the vibrato. It can then calculate a target pitch ratio which can represent the ratio of a time period during which the fundamental frequency matches the target frequency to the duration of the vibrato. Analysis module 114 can also calculate an above target pitch ratio which can represent the ratio of a time period during which the fundamental frequency is greater than the target frequency to the duration of the vibrato. Similarly, analysis module 114 can calculate a below target pitch ratio which can represent the ratio of a time period during which the fundamental frequency is less than the target frequency to the duration of the vibrato. Additionally or alternatively, analysis module 114 can calculate a vibrato ratio which can represent the ratio of the above target pitch ratio to the below target pitch ratio.

As another example, analysis module 114 can determine the correspondent relationship between the frequency and intensity variations. More particularly, for example, analysis module 114 can determine the positions of the intensity peaks in a cycle of vibrato. Analysis module 114 can then determine the correspondent relationship between the intensity peaks and the fundamental frequencies. For example, analysis module 114 can determine that the intensity peaks are aligned with the fundamental frequency peaks, the fundamental frequency troughs, the target pitch, etc. In some embodiments, a close and consistent alignment between the intensity peaks and the target pitch can indicate the intonation of the vibrato recorded in the audio file. For example, analysis module 114 can determine that the intensity peaks are substantially and consistently aligned with the target pitch in a cycle of vibrato. Analysis module 114 can then determine that the vibrato recorded in the audio file was played with good intonation. As another example, analysis module 114 can determine that the intensity peaks are substantially and consistently aligned with the fundamental frequency peaks or troughs in a cycle of vibrato. Analysis module 114 can then determine that the vibrato recorded in the audio file was played with good intonation. Alternatively, analysis module 114 can determine that some of the intensity peaks in a cycle of vibrato are substantially aligned with the fundamental frequency peaks while the others are substantially aligned with the fundamental frequency troughs. Analysis module 114 can then determine that the vibrato recorded in the audio file was not played with good intonation.

Figure 10:
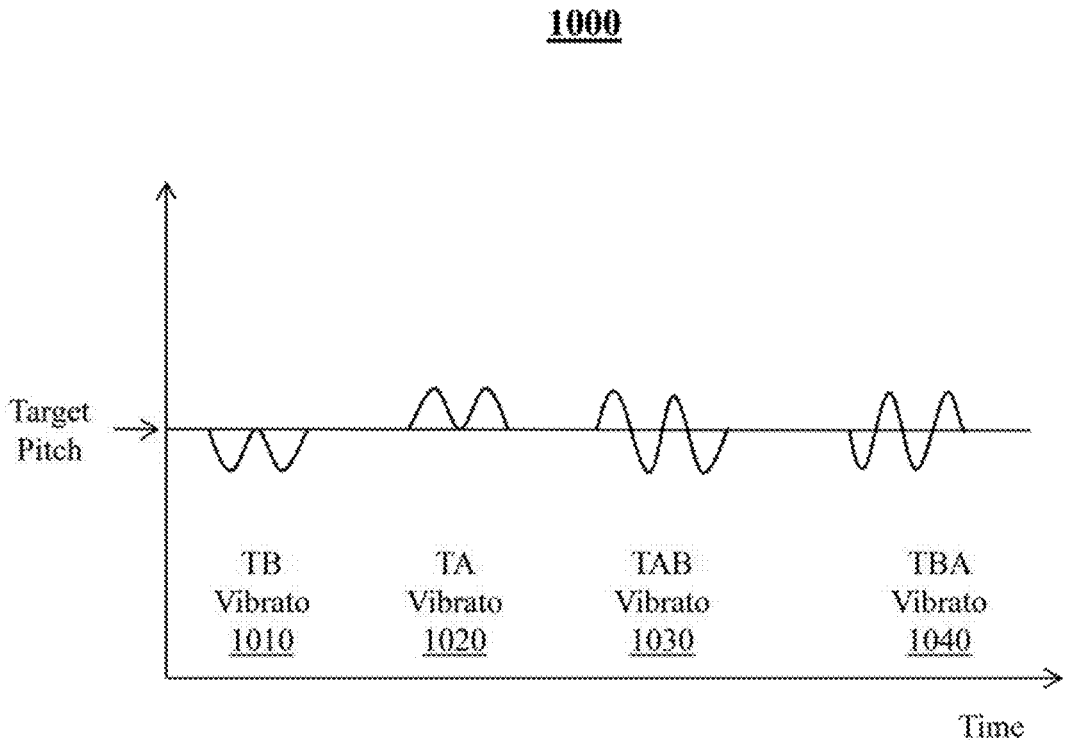
FIG. 10 is an example of Various types of vibratos.

As yet another example, analysis module 114 can determine the type of the vibrato recorded in the audio file. As illustrated in FIG. 10, there can be various types of vibratos. For example, a user can play the target note with vibrato by starting at the target pitch corresponding to the vibrato note (e.g., the in-tune pitch). The user can then play a TB vibrato 1010 by producing oscillation between the target pitch and a frequency lower than the target pitch (i.e., a lower frequency). Similarly, the user can play a TA vibrato 1020 by producing oscillation between the target pitch and a frequency higher than the target pitch (i.e., a higher frequency). Alternatively, the user can play a TAB vibrato 1030 or a TBA vibrato 1040 by producing oscillation between a higher frequency and as lower frequency.

In some embodiments, analysis module 114 can determine the type of the vibrato recorded in the audio file based on an initial motion after the fundamental frequency reaches the target pitch for the first time and the correspondent relationship between the intensity peaks and the fundamental frequencies in a vibrato cycle. For example, analysis module 114 can determine that the vibrato recorded in the audio file was played by starting at the target pitch and producing an oscillation using an initial motion after the target pitch was reached for the first time. In a more particular example, analysis module 114 can determine that the vibrato was produced by a backward motion (e.g., moving one's fingers toward the violin scroll) or a forward motion (e.g., moving one's fingers toward the violin bridge) after the target pitch was reached for the first time. In another more particular example, analysis module 114 can determine that the vibrato recorded in the audio file was produced by a backward motion after the target pitch was reached for the first time and the intensity peaks were substantially aligned with the fundamental frequency peaks. Analysis module 114 can then determine that the vibrato recorded in the audio file is a TB vibrato. In another more particular example, analysis module 114 can determine that the vibrato recorded in the audio file was produced by a forward motion after the target pitch was reached for the first time and the intensity peaks were substantially aligned with the fundamental frequency troughs. Analysis module 114 can then determine that the vibrato recorded in the audio file is a TA vibrato. In another more particular example, analysis module 114 can determine that the vibrato recorded in the audio file was produced by a forward motion after the target pitch was reached for the first time and the intensity peaks are aligned with the target pitch. Analysis module 114 can then determine that the vibrato recorded in the audio file is a TBA vibrato.

Alternatively or additionally, analysis module 114 can determine the type of vibrato recorded in the audio file based on the vibrato ratio. For example, analysis module 114 can determine that the vibrato recorded in the audio file is a TB vibrato if the vibrato ratio is less than or equal to 0.5. As another example, analysis module 114 can determine that the vibrato recorded in the audio file is a TA vibrato lithe vibrato ratio is greater than or equal to 2. Alternatively, analysis module 114 can determine that the vibrato recorded in the audio file is a TBA/TAB vibrato if the vibrato ratio falls within the interval (0.5, 2).

Figure 6:
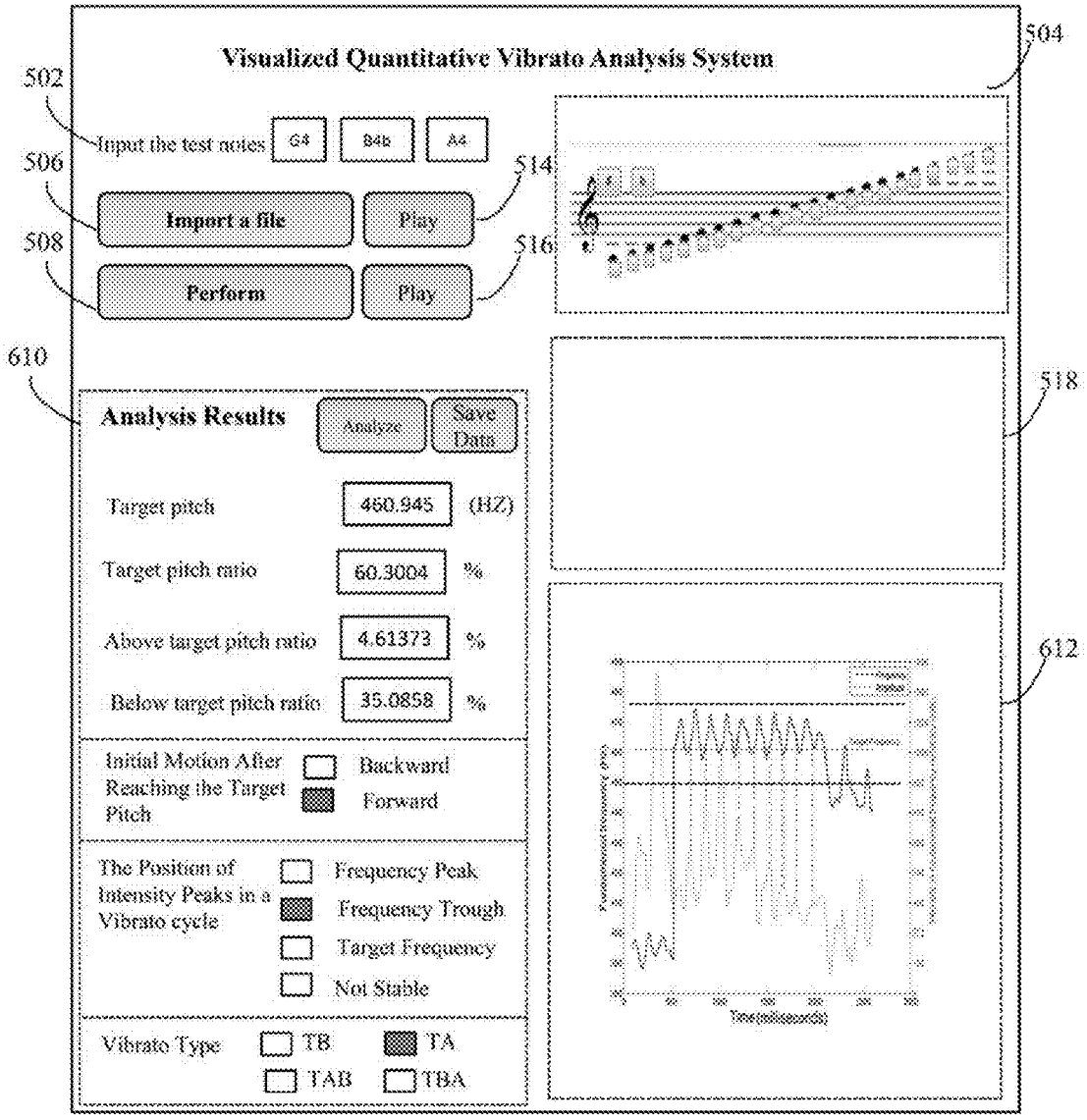
FIG. 6 is an example of a user interface for displaying vibrato analysis results in accordance with some implementations of the disclosed subject matter.
Figure 7:
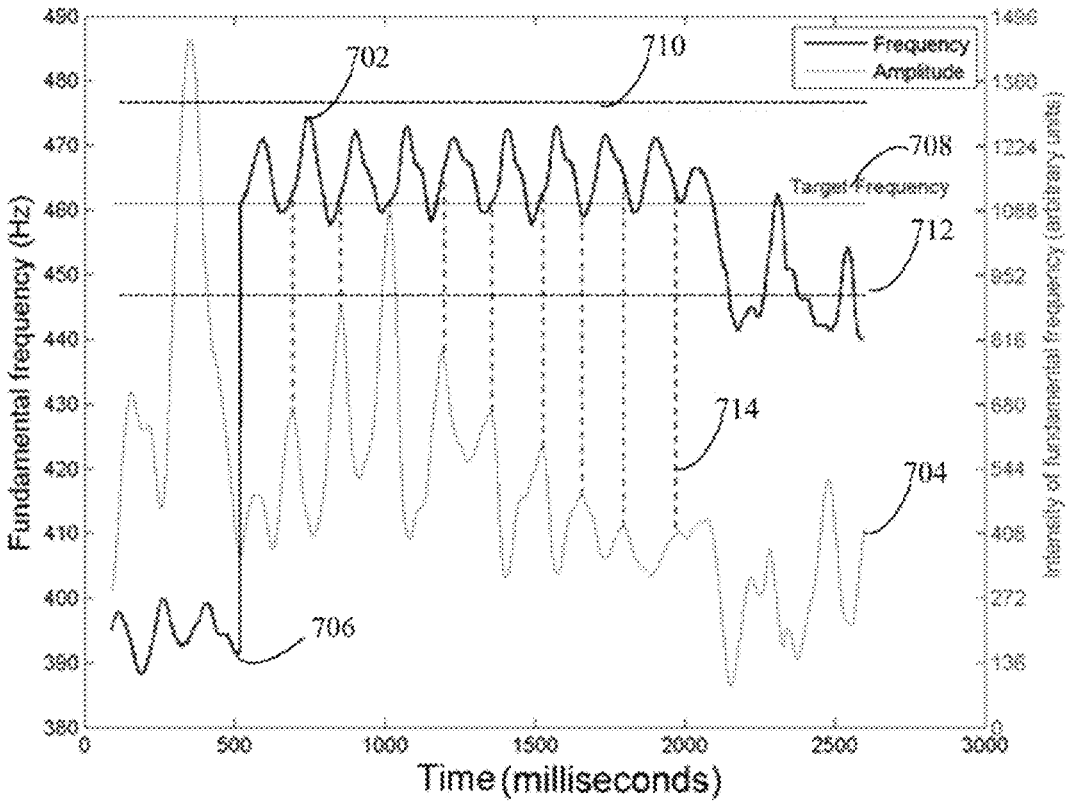
FIG. 7 is an example of a two-dimensional graphic illustrating a representation of spectrum data in accordance with some implementations of the disclosed subject matter.
Figure 8:
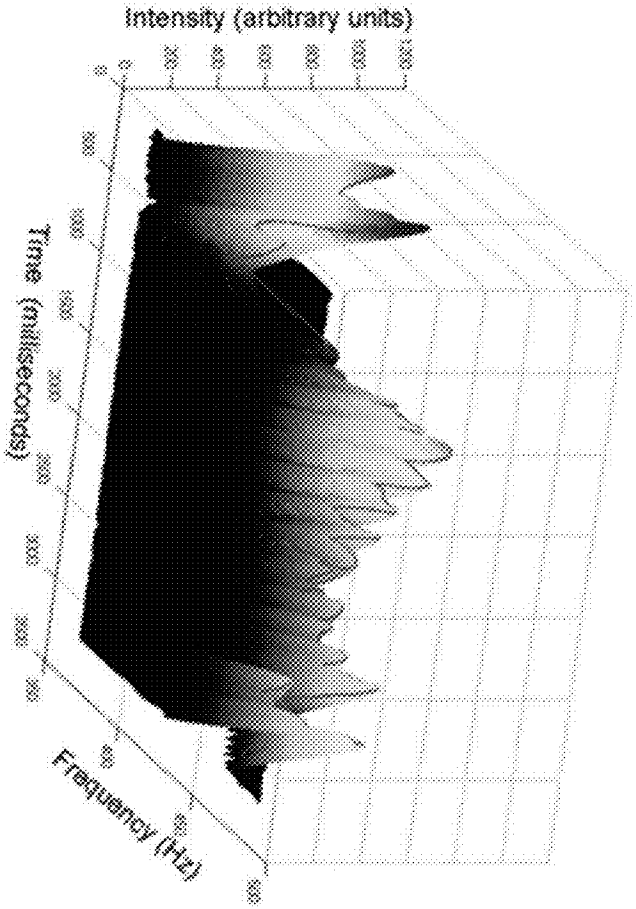
FIG. 8 is an example of a three-dimensional graphic illustrating a representation of spectrum data in accordance with some implementations of the disclosed subject matter.

At 210, display device 120 can display to the user the spectrum data and the characteristics of the vibrato applied to the target note. For example, display device 120 can display the spectrum data and the characteristics using a suitable user interface. More particularly, for example, as shown in FIG. 6, display device 120 can display in area 610 of user interface 600 the target pitch or frequency, a target pitch ratio, an above target pitch ratio, a below target pitch ratio, a vibrato ratio, an initial motion after reaching the target pitch, the position of the intensity peak in a vibrato cycle, and other characteristics of the vibrato. As another example, display device 120 can display the spectrum data calculated at 206 in display area 612 of user interface 600. More particularly, for example, variations of the fundamental frequency and intensity of vibrato can be plotted versus time and displayed in area 612. In some embodiments, display device 120 can display a two-dimensional graphic as illustrated in FIG. 7. Alternatively or additionally, display device 120 can display a three-dimensional graphic as illustrated in FIG. 8 in display area 612.

It should be understood that some of the above steps of the flow diagram of FIG. 2 can be executed or performed in an order or sequence other than the order and sequence shown and described in the figure. Also, some of the above steps of the flow diagram of FIG. 2 may be executed or performed well in advance of other steps, or may be executed or performed substantially simultaneously or in parallel.

Figure 3:
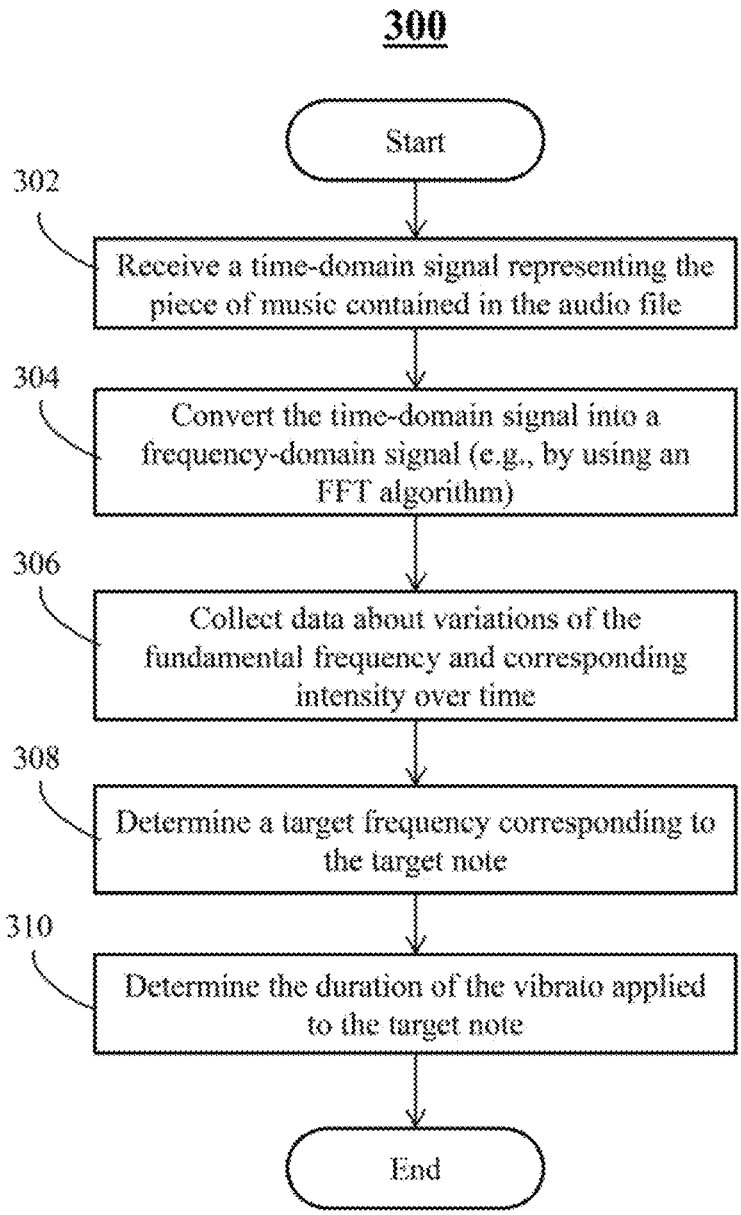
FIG. 3 is a flow chart of an example of a process for performing spectrum analysis on an audio file in accordance with some implementations of the disclosed subject matter.

Turning to FIG. 3, a flow chart of an example of a process for performing spectrum analysis on an audio file in accordance with some implementations of the disclosed subject matter is shown.

As illustrated, process 300 can begin by receiving a time-domain signal representing the piece of music contained in the audio file by computing device 110 at 302. For example, processing module 112 can load an audio file in any suitable format and read a time-domain signal which can represent a sound waveform recorded in the audio file.

Next, at 304, computing device 110 can convert the time-domain signal into a frequency-domain signal. For example, processing module 112 can perform a fast Fourier transform (FFT) on the time-domain signal. More particular, for example, processing module 112 can compute the frequency spectrum corresponding to a time series segment of the time-domain signal using the Hann window function. Processing module 112 can identify the frequency with the highest intensity near a note's standard frequency as the instantaneous frequency of the time series segment. Processing, module 117 can then applying FFT analysis to another segment of the time-domain signal. For example, processing module 112 can analyze a second time-series segment having the same length as that of the first time-series segment while shifting the width of the second time-series segment with a small percentage along the time series (e.g., 5%). Processing module 112 can perform the spectrum analysis described above iteratively and compute the spectrum and the instantaneous frequencies for the entire time-domain signal.

At 306, computing device 110 can collect data about variations of the fundamental frequency and the intensity of the fundamental frequency over time. For example, graphic module 116 can generate a two-dimensional spectrum graphic representing the changes in the fundamental frequency and the intensity of the fundamental frequency over time. More particular, for example, graphic module 116 can generate graphic 700 as illustrated in FIG. 7. Graphic 700 can include frequency variation curve 702, intensity variation curve 704, upper frequency limit line 710, lower frequency limit hue 712, and dash lines 714. Graphic module 116 can generate frequency variation curve 702 by plotting the fundamental frequency versus time. Similarly, graphic module 116 can generate intensity variation curve 704 by plotting the intensity of the fundamental frequency versus time. In some embodiments, the crest of curve 704 can be linked to a corresponding point on curve 702 by dashed lines 714. A user can learn when the vibrato intensity of the peaks is stably falling on or near target frequency line. For example, as illustrated in FIG. 7, the vibrato recorded in the audio file can start from target frequency or pitch 708. The vibrato can then be produced by a forward motion followed by returning back to the target pitch. As illustrated by dashed lines 714, the intensity peaks within the duration of the vibrato are substantially and consistently aligned with the fundamental frequency troughs. As described above in connection with FIG. 2, such alignment between the intensity peaks and the target pitch can indicate that the vibrato recorded in the audio file was played with good intonation. FIG. 7 can also include lines 710 and 712 that can represent the upper and lower frequency limits of the vibrato respectively. In some embodiments, playback device 140 can play a tone to remind the user when the vibrato frequency approaches the upper or lower limit.

Alternatively or additionally, graphic module 116 can generate a three-dimensional spectrum graphic (e.g., a waterfall graphic) which can represent the changes in the fundamental frequency and the intensity of the fundamental frequency over time. More particular, for example, graphic module 116 can generate a three-dimensional graphic 800 as illustrated in FIG. 8 by linking the peaks of all of the instantaneous frequencies.

Referring back to FIG. 3, at 308, computing device 110 can determine a target frequency corresponding to the target note. For example, analysis module 114 can determine the target frequency corresponding to the target note based on a fundamental frequency corresponding to the preceding note. In a more particular example, as shown in FIG. 4, the target note can be $B^b4$ and the note preceding the target note can be G4. As shown in FIG. 7, when the note being played instantaneously switches from G4 to $B^b4$, the fundamental frequency increases significantly. For example, the fundamental frequency can change from fundamental frequency 706 corresponding to the preceding note to fundamental frequency 708. Analysis module 114 can then determine that the target frequency (or pitch) corresponding to the target note is fundamental frequency 708.

Referring back to FIG. 3, at 310, computing device 110 can determine the duration of the vibrato. For example, analysis module 114 can determine the duration of the vibrato based on the fundamental frequencies corresponding to the preceding note and the subsequent note. In a more particular example, as described in connection with FIG. 4, the target note can be $B^b4$ and the preceding note and the subsequent note can be G4 and A4, respectively. As described above, analysis module 114 can determine the start of the vibrato by identifying a significant increase of the fundamental frequency from a fundamental frequency corresponding to the preceding note G4 to a fundamental frequency corresponding to the target note $B^b4$. Similarly, analysis module 114 can determine the end of the vibrato by identifying a significant decrease of the fundamental frequency from as fundamental frequency corresponding to the target note $B^b4$ to as fundamental frequency corresponding to the subsequent note A4.

Analysis module 114 can then determine the duration of the vibrato based on the start and the end of the vibrato.

It should be understood that some of the above steps of the flow diagram of FIG. 3 can be executed or performed in an order or sequence other than the order and sequence shown and described in the figure. Also, some of the above steps of the flow diagram of FIG. 3 may be executed or performed well in advance of other steps, or may be executed or performed substantially simultaneously or in parallel.

Turning to FIG. 4, an example of as music sheet of a piece of music including a target note which can be played with vibrato in accordance with some implementations of the disclosed subject matter is shown.

As illustrated, music sheet 400 includes notes 420, 410, and 430 which can be played sequentially. In some embodiments, note 410 can be played with vibrato. As described above, a user can identify note 410 as a target note. The user can also identify notes 420 and 430 as a preceding note and a subsequent note, respectively.

In some embodiments, a user can play music sheet 400 and apply vibrato to note 410 with a musical instrument. As descried above, recording device 130 can record the user's performance in real time and produce an audio file accordingly. In some embodiments, a user can import an audio file on which music sheet 400 played by a musician has been recorded.

Turning to FIG. 5, an example of a user interface for performing visualized quantitative vibrato analysis in accordance with some implementations of the disclosed subject matter is shown. As illustrated, user interface 500 can be displayed on a screen of display device 120. User interface 500 can include test notes input area 502, staff panel 504, import a file button 506, perform button 508, analysis results display area 510, spectrum data display area 512, play buttons 514 and 516, and video display area 518.

As described above in connection with FIG. 2, a user can enter in test notes input area 502 three notes that can be played sequentially. System 100 can identify the second note entered by the user as the target note. For example, as user can enter G4, B4b, and A4 in test notes input area 502 to identify a preceding note, a target note, and a subsequent note as illustrated in FIG. 4. Alternatively or additionally, as user can identify a target note, a preceding note, and a subsequent note using staff panel 504. For example, the user can click the portion of staff panel 504 corresponding to B4 and the sharp button "b" to identify note $B^b4$. The user can also click the portions of staff panel 504 corresponding to A4 and G4 sequentially to identify a preceding note and a subsequent note, respectively.

As described above in connection with FIG. 2, a user can click import a file button 506 to import a pre-recorded audio file containing a piece of music in which the target note is played with vibrato. For example, the user can import a pre-recorded audio file by identifying the location and name of the audio file to be imported using input device 150. After an audio file is imported, the user can click play button 514 to instruct playback device 140 to play the recorded audio file.

Alternatively or additionally, a user can click perform button 508 of user interface 500 to record an audio file containing a piece of music in which the target note is played with vibrato. For example, the user can play a piece of music by applying vibrato to the target note with a musical instrument. Recording device 130 can record the user's performance and produce an audio file accordingly. The user can click play button 516 of user interface 500 to instruct playback device 140 to play the recorded audio file. Alternatively or additionally, the user can click perform button 508 to record a video file. The user can then click play button 516 to display the video in video display area 518.

As illustrated in FIG. 5, user interface 500 can also include display areas 510 and 512. Display area 510 can be used to display multiple characteristics of the vibrato applied to the target note. Examples of the characteristics of the vibrato can include a target pitch, a target pitch ratio, an above target pitch ratio, a below target pitch ration, a vibrato ratio, an initial motion after reaching the target pitch, the position of the intensity peak in a vibrato cycle, the type of the vibrato, and other characteristics of the vibrato. Display area 512 can be used to display spectrum data about the vibrato applied to the target note. For example, display device 120 can display the spectrum data including the variations of the fundamental frequency and its corresponding intensity over time in two-dimensional or three-dimensional graphics. In some embodiments, computing device 110 can synchronize a video file and the spectrum data corresponding to the video file. Display device 120 can simultaneously and synchronously display the video file and the spectrum data in display areas 518 and 512, respectively. In some embodiments, a pointer can be shown in spectrum data display area 512 to indicate a portion of the spectrum data corresponding to a portion of the video file that is being displayed in display area 518. In some embodiments, a user can identify a portion of the spectrum data displayed in area 512 using a pointer. Display device 120 can display in video display area 518 a portion of the video file corresponding to the portion of the spectrum data identified by the user (e.g., by the user repositioning a pointer in the spectrum data).

Figure 9:
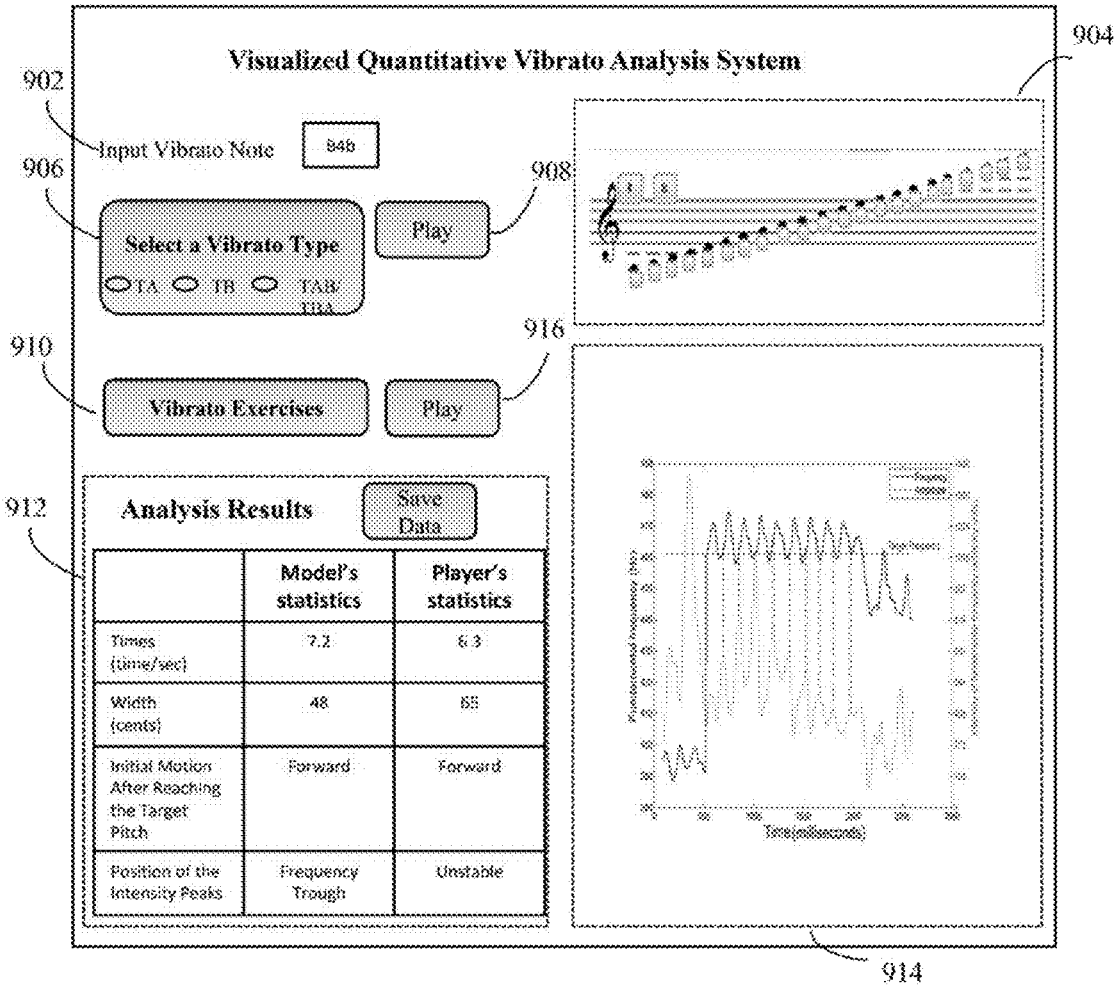
FIG. 9 is an example of a user interface for performing vibrato training in accordance with some implementations of the disclosed subject matter.

Turning to FIG. 9, an example of a user interface for performing vibrato training in accordance with some implementations of the disclosed subject matter is shown. In some embodiments, user interface 900 can be displayed on a screen of display device 120. As shown, user interface 900 can include target note input area 902, staff 904, vibrato type input area 906, play sample button 908, vibrato exercises button 910, display areas 912 and 914.

In some embodiments, a user can identify as target note by entering the name of the vibrato note in area 902. For example, the user can enter $B^b4$ as a target note in area 902. Alternatively or additionally, the user can identify a target note by selecting a portion of staff 904 corresponding to the vibrato note. For example, a user can click the portion of staff 904 corresponding to B4 and the flat button "b" to identify $B^b4$ as a target note.

The user can also select a vibrato type that will be applied to the target note in area 906. As described above in connection with FIGS. 5 and 10, there can be various types of vibratos. For example, a user can play the target note with a TB vibrato, a TA vibrato, a TAB vibrato, or a TBA vibrato. As shown in FIG. 9, as user can select TA, TB, or TAB/TBA as the type of vibrato that will be applied to the target note.

The user can then click play sample button 908 of user interface 900 to instruct playback device 140 to play a sample audio file in which the target note is played with the type of vibrato selected by the user. For example, computing device 110 can impart the type of vibrato effect selected by the user to the target tone and generate an audio file accordingly. As another example, computing device 110 can retrieve an audio file including the target note played with vibrato by a musician. In some embodiments, the user can use the sample audio file to study the preferable way to play the type of vibrato selected by the user.

The user can then click vibrato exercises panel 910 to practice playing vibrato with a musical instrument. In some embodiments, the user can play the target note without vibrato. Computing device 110 can then determine the target pitch corresponding to the target note played by the user. In some embodiments, the user can play the target note with vibrato. Computing device 110 can analyze the user's performance. For example, computing device 110 can perform spectrum and quantitative analysis on the user's performance based on the methods described in connection with FIGS. 2 and 3.

Computing device 110 can also generate multiple statistics about the sample audio file and the user's performance. Display device 120 can then display the statistics in display are 912 of user interface 900. Computing device 110 can also generate a graphic illustrating the statistics and the difference between the sample performance and the user's performance. Display device 120 can then display the graphic in display area 914 of user interface 900. For example, as described above in connection with FIGS. 7 and 8, computing device 110 can generate as two-dimensional or three-dimensional graphic illustrating the changes in fundamental frequency and its corresponding intensity over time within the vibrato.

In some implementations, any suitable computer readable media can be used for storing instructions for performing the processes described herein. For example, in some implementations, computer readable media can be transitory or non-transitory. For example, non-transitory computer readable media can include media such as magnetic media (such as hard disks, floppy disks, etc.), optical media (such as compact discs, digital video discs, Blu-ray discs, etc.), semiconductor media (such as flash memory, electrically programmable read only memory (EPROM), electrically erasable programmable read only memory (EEPROM), etc.), any suitable media that is not fleeting or devoid of any semblance of permanence during transmission, and/or any suitable tangible media. As another example, transitory computer readable media can include signals on networks, in wires, conductors, optical fibers, circuits, any suitable media that is fleeting and devoid of any semblance of permanence during transmission, and/or any suitable intangible media.

Although the application is described herein as being implemented on a user computer and/or server, this is only illustrative. The application may be implemented on any suitable platform (e.g., a personal computer ("PC"), a data display, a portable computer, a palmtop computer, a handheld PC, a laptop computer, a cellular phone, a personal digital assistant ("PDA"), a combined cellular phone and PDA, etc.) to provide such features.

Accordingly, methods, systems, and media for performing visualized quantitative vibrato analysis are provided.

Although the disclosed subject matter has been described and illustrated in the foregoing illustrative implementations, it is understood that the present disclosure has been made only by way of example, and that numerous changes in the details of implementation of the disclosed subject matter can be made without departing from the spirit and scope of the disclosed subject matter. For example, although the present invention has been described as performing visualized quantitative vibrato analysis in connection with the playing of a violin, visualized quantitative vibrato analysis can be performed in connection with vocal music or any suitable musical instruments, such as a cello, a viola, a guitar, any other musical instrument in which vibrato can be effected, etc. Features of the disclosed implementations can be combined and rearranged in various ways.

What is claimed is:

1. A method for analyzing musical vibrato in an audio file, comprising:

receiving, using a hardware processor, a target note from a user;

receiving, using the hardware processor, a time-domain signal representing a piece of music comprising a plurality of notes, wherein the plurality of notes include the target note and the target note is played with a vibrato effect having a frequency;

converting, using the hardware processor, the time-domain signal to a frequency-domain signal;

determining, using the hardware processor, a plurality of changes in frequency and intensity of the vibrato effect over time based on the frequency-domain signal;

determining, using the hardware processor, a target frequency corresponding to the target note;

displaying, on a display, data about the changes in frequency and intensity of the vibrato effect over time and data about the target frequency;

determining, using the hardware processor, a first frequency corresponding to a first note and a second frequency corresponding to a second note, wherein the first note is played before the target note and the second note is played after the target note;

determining, using the hardware processor, a first time period during which the vibrato effect is played;

determining, using the hardware processor, a second time period during which the frequency of the vibrato effect matches the target frequency;

calculating, using the hardware processor, a first ratio of the second time period to the first time period;

determining, using the hardware processor, a third time period during which the frequency of the vibrato effect is greater than the target frequency; and calculating, using the hardware processor, a second ratio of the third time period to the first time period.

2. The method of claim 1, further comprising:

displaying, on the display, at least one of the first ratio and the second ratio.

3. A system for analyzing musical vibrato in an audio file, comprising:

at least one hardware processor that is configured to:

receive a target note from a user;

receive a time-domain signal representing a piece of music comprising a plurality of notes, wherein the plurality of notes include the target note and the target note is played with a vibrato effect that has a frequency;

convert the time-domain signal to a frequency-domain signal;

determine a plurality of changes in frequency and intensity of the vibrato effect over time based on the frequency-domain signal;

determine a target frequency corresponding to the target note;

determine a first frequency corresponding to a first note and a second frequency corresponding to a second note, wherein the first note is played before the target note and the second note is played after the target note;

determine a first time period during which the vibrato effect is played;

determine a second time period during which the frequency of the vibrato effect matches the target frequency;

calculate a first ratio of the second time period to the first time period;

determine a third time period during which the frequency of the vibrato effect is greater than the target frequency; and calculate a second ratio of the third time period to the first time period; and at least one display that is configured to:

display data about the changes in frequency and intensity of the vibrato effect over time and data about the target frequency.

4. The system of claim 3, wherein the at least one display is further configured to display at least one of the first ratio and the second ratio.

5. A non-transitory computer readable medium containing computer-executable instructions that, when executed by a processor, cause the processor to perform a method for analyzing musical vibrato in an audio file, comprising:

receiving a target note from a user;

receiving a time-domain signal representing a piece of music comprising a plurality of notes, wherein the plurality of notes include the target note and the target note is played with a vibrato effect having a frequency;

converting the time-domain signal to a frequency-domain signal;

determining a plurality of changes in frequency and intensity of the vibrato effect over time based on the frequency-domain signal;

determining a target frequency corresponding to the target note;

displaying data about the changes in frequency and intensity of the vibrato effect over time and data about the target frequency;

determining a first frequency corresponding to a first note and a second frequency corresponding to a second note, wherein the first note is played before the target note and the second note is played after the target note;

determining a first time period during which the vibrato effect is played;

determining a second time period during which the frequency of the vibrato effect matches the target frequency;

calculating a first ratio of the second time period to the first time period;

determining a third time period during which the frequency of the vibrato effect is greater than the target frequency; and calculating a second ratio of the third time period to the first time period.

6. The non-transitory computer readable medium of claim 5, wherein the method further comprises:

displaying at least one of the first ratio and the second ratio.

* * * * *